US006390270B1

(12) United States Patent
Utsunomiya et al.

(10) Patent No.: US 6,390,270 B1
(45) Date of Patent: May 21, 2002

(54) ESCALATOR

(75) Inventors: Hirofumi Utsunomiya, Oarai-machi; Chuichi Saito, Hitachinaka; Kazuhira Ojima, Kasama, all of (JP)

(73) Assignees: Hitachi, Ltd.; Hitachi Building Systems Co., Ltd., both of Tokyo (JP)

( * ) Notice: Subject to any disclaimer, the term of this patent is extended or adjusted under 35 U.S.C. 154(b) by 0 days.

(21) Appl. No.: 09/486,330

(22) PCT Filed: Apr. 26, 1999

(86) PCT No.: PCT/JP99/02210

§ 371 Date: Feb. 25, 2000

§ 102(e) Date: Feb. 25, 2000

(87) PCT Pub. No.: WO00/64799

PCT Pub. Date: Nov. 2, 2000

(51) Int. Cl.[7] ..... B66B 21/00
(52) U.S. Cl. ..... 198/326; 198/804
(58) Field of Search ..... 198/321, 323, 198/326, 330, 329, 332, 334, 804, 810.01, 812

(56) References Cited

U.S. PATENT DOCUMENTS 4,397,096 A * 8/1983 Kraft et al. ..... 198/330

* cited by examiner

*Primary Examiner*—Kenneth W. Noland
(74) *Attorney, Agent, or Firm*—Antonelli, Terry, Stout & Kraus, LLP

(57) ABSTRACT

In an escalator having a plurality of steps connected to an endless chain and moved along an endless path, a rotation locus of step forward wheels at both end portions is shifted toward end portions of the escalator relative to a rotation locus of the chain. A forward wheel guide track for guiding forward wheels of the steps is arranged, at both end portions of the escalator, so that a straight distance between forward wheels of two adjacent steps, which distance tends to be shortened by the chain following an arc at both end portions, is extended. By such constructions, interference between adjacent steps hardly occurs even if the rotation diameter of the steps at each end portion of the escalator is made small. Therefore, the rotation diameter of the steps can be made smaller than a conventional one and the escalator thickness (depth) can be made small.

20 Claims, 8 Drawing Sheets

81···CHAIN LINK 82,83···PIN HOLE 84···LINK PIN 85···TRIANGULAR SPECIFIC LINK
86,87···TRIANGULAR SPECIFIC LINK PIN HOLE 88···SPECIFIC PIN HOLE

2···STEP 8···CHAIN 23···FORWARD WHEEL 24···BACKWARD WHEEL
62···DRIVING SPROCKET 91···FORWARD WHEEL GUIDE RAIL
92···BACKWARD WHEEL GUIDE RAIL 231···FORWARD WHEEL SHAFT
241···BACKWARD WHEEL SHAFT

81···CHAIN LINK 82···PIN HOLE 85···TRIANGULAR SPECIFIC LINK
86,87···TRIANGULAR SPECIFIC RING PIN 88···SPECIFIC PIN HOLE
h11,h12···SAFETY DISTANCE hs···HEIGHT OF STEP
91···FORWARD WHEEL GUIDE RAIL
92···BACKWARD WHEEL GUIDE RAIL
r···ROTATION DIAMETER OF BACKWARD WHEEL

89···TRIANGULAR SPECIFIC LINK 893···ELLIPSE
h21,h22···SAFTY DISTANCE
r···ROTATION DIAMETER OF BACKWARD WHEEL
91···FORWARD WHEEL GUIDE RAIL
92···BACKWARD WHEEL GUIDE RAIL

89···TRIANGULAR SPECIFIC LINK 893···ELLIPSE
231···FORWARD WHEEL SHAFT 81···CHAIN LINK
82,83···PIN HOLE 84···LINK PIN

23a···POTATION LOCUS OF STEP FORWARD WHEEL
23b···ROTATION LOCUS CENTER OF STEP FORWARD WHEEL
24a···ROTATION LOCUS OF STEP BACKWARD WHEEL
23b···ROTATION LOCUS CENTER OF STEP BACKWARD WHEEL
62···DRIVING SPROCKET 91···FORWARD WHEEL GUIDE RAIL
92···BACKWARD WHEEL GUIDE RAIL

ESCALATOR

TECHNICAL FIELD

The present invention relates to improvements in an escalator apparatus, and provides an escalator apparatus in which the distance (depth) from the floor at an end of the escalator where passengers get on or get off to a lower portion of the escalator body is reduced in size.

BACKGROUND OF THE INVENTION

As disclosed in JP A 49-80790 and JP A 49-55083, for example, a basic construction of an escalator apparatus includes a plurality of steps connected to each other by a driven endless chain, thereby to transport passengers on the steps. In this escalator construction, the distance (depth) from the floor of the escalator where passengers get on or get off to a lower portion of the escalator body is determined according to the diameter of arc through which the steps rotate at both ends of the escalator.

In an example of a conventional escalator apparatus, the distance from the floor at the end of the escalator to a lower portion of the escalator body is 1000 mm, the length of a tread board of each step is 408 mm, the maximum thickness of the each step is 360 mm, the height of each step is 335 mm, the rotation diameter of a step backward wheel is 264 mm and a safety distance at each of up and down portions is about 20 mm. Further, the diameter of the driving sprocket is 654.36 mm, the number of teeth on the sprocket is 30 teeth and the number of pitches of the drive chain between adjacent forward wheel shafts is 6 pitches.

However, in the above-mentioned conventional escalator, it is impossible to reduce the diameter of the arc through which the steps rotate at both ends, therefore, there is a problem that the distance (depth) from the floor at the end of the escalator to a lower portion of the escalator body (hereunder, referred to as escalator thickness) is large.

An object of the present invention is to provide an escalator apparatus in which the escalator thickness is small.

SUMMARY OF THE INVENTION

A feature of the present invention is to provide, in an escalator having a plurality of steps which are connected endlessly and driven along a path, means for shifting the rotation locus of connection portions between steps at both ends of the escalator and the driving chain toward an end portion of the escalator from a moving locus of the chain.

Further, as another feature of the present invention, there is provided means for guiding the chain so that a moving locus of the chain draws an arc at both ends thereof, and step guide means for guiding the chain so as to extend, at both escalator ends, a straight distance between the connecting portions of two adjacent steps with the chain, which tend to be shortened by drawing the arc.

With such a construction, interference between adjacent steps will hardly occur even if the diameter of the arc through which the steps move at both ends of the escalator is made small. Therefore, the diameter of the path of the steps at the ends of the escalator can be smaller than in a conventional escalator, and the above-mentioned escalator thickness can be made small.

Further, another feature of the present invention resides in the fact that the escalator thickness is more than twice as large as the height of a step and less than twice as long as the length of a tread board in a running direction. By constructing an escalator in this manner, an escalator in which the escalator thickness is made small can be realized.

BEST MODE OF THE INVENTION

Figure 1:
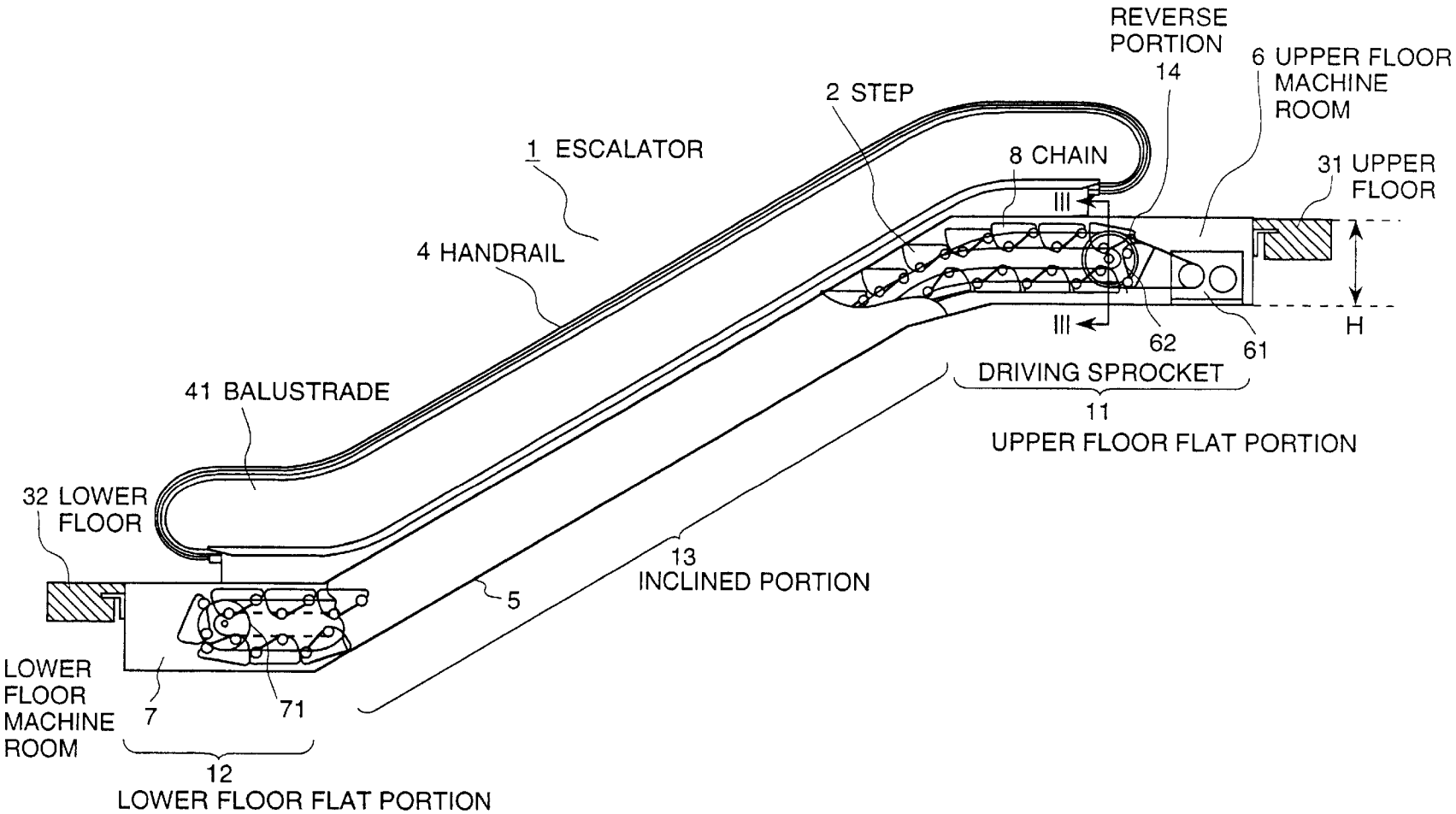
FIG. 1 is a side view showing the overall construction of an escalator according to the present invention.

An embodiment of the present invention will be explained hereunder, with reference to the drawings. First, a structural portion of an escalator according to the present invention, which is common to a general escalator will be explained with reference to FIGS. 1 to 4. An escalator apparatus 1 has a plurality of steps 2 which are endlessly connected and driven along a path, so as to transport passengers between an upper floor 31 and a lower floor 32. A handrail 4 and a balustrade 41 supporting the handrail 4 are provided for the security and safety of each passenger. The steps 2, handrail 4, balustrade 41, etc. are supported by a main frame 5, and both end portions of the main frame 5 are fixed to the upper floor 31 and lower floor 32 on the housing side, respectively.

The escalator apparatus 1 comprises an upper floor flat portion 11 and a lower flower flat portion 12 at which passengers get out and get on, and an inclined portion 13 connecting the upper and lower floor flat portions for transporting the passengers. In an upper floor machine room 6 of the upper floor flat portion, a driving machine 61 is provided to drive a driving sprocket 62. On the other hand, in a lower floor machine room 7 of the lower floor flat portion 12, a driven sprocket 71 is installed, a endless chain 8 is wound about each of the upper driving sprocket 62 and the lower driven sprocket 71 so as to extend therebetween, and the chain 8 is reversed in its direction at the escalator end portions. The above-mentioned plurality of steps 2 are connected to the chain 8.

Figure 2:
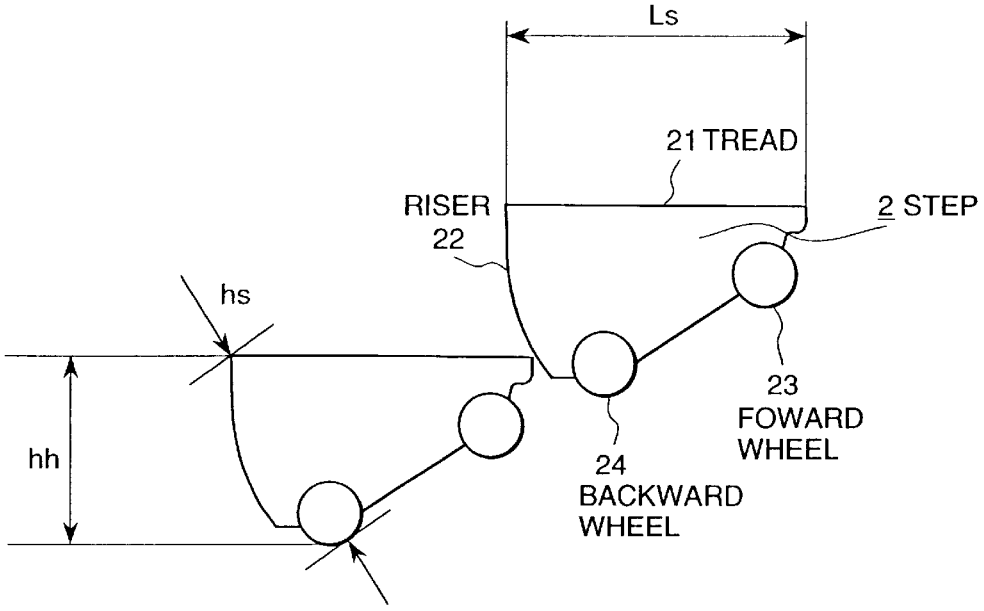
FIG. 2 is a side view showing the construction of the steps.

As shown in FIG. 2, the steps 2 each are composed of a tread board 21, a riser 22, a forward wheel 23 and a backward wheel 24. The length Ls of the tread 21 of the step 2 in a running direction will be referred to as the length of the tread 21 hereunder, the distance from a tread surface of the backward wheel 24 to a top of the riser 22 will be defined as the maximum thickness hs and the depth hh from the tread 24 to the backward wheel in a height direction will be called the height of step 2 hereunder.

Figure 3:
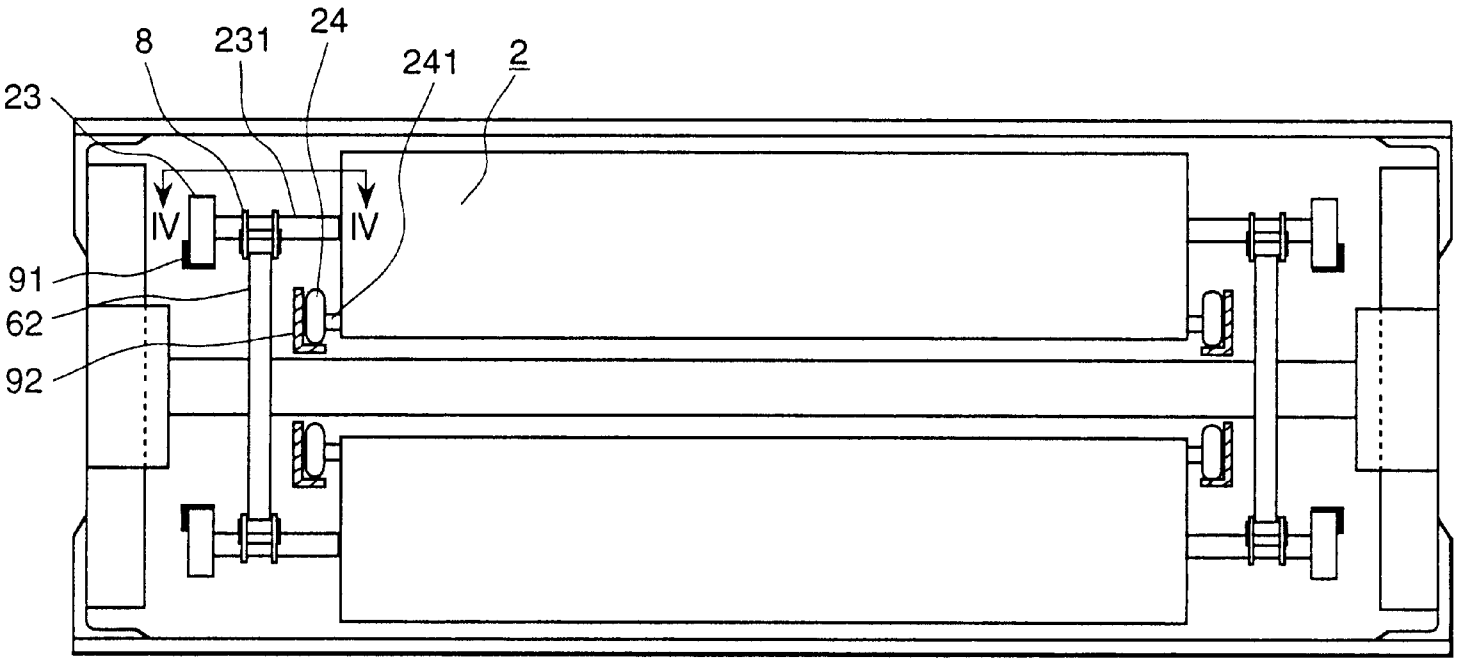
FIG. 3 is a sectional view of an upper floor flat portion taken along a line III—III of FIG. 1.

Next, a construction of the steps 2 and the chain 8 in the upper floor flat portion 11 will be explained with reference to FIG. 3 and FIG. 4. FIG. 3 is a sectional view of the upper floor flat portion in FIG. 1, wherein left and right sides are symmetrically constructed, so that explanation of some of the parts is provided only with respect to the left upper half portions. The step 2 has a forward wheel shaft 231 and a backward wheel shaft 241. The forward wheel shaft 231 and backward wheel shaft 241 of each step are provided with a pair of forward wheels 23 and a pair of backward wheels 24, respectively. The forward wheels 23 each are positioned further outside (both left and right end sides in FIG. 3) than the backward wheels 24, and are arranged at a more upper side than the backward wheels 24 in a forward course (on the upper side) of the path of the steps 2. The forward wheel shaft 231 also is connected to the chain 8 and moves the step 2 according to movement of the chain 8.

Figure 4:
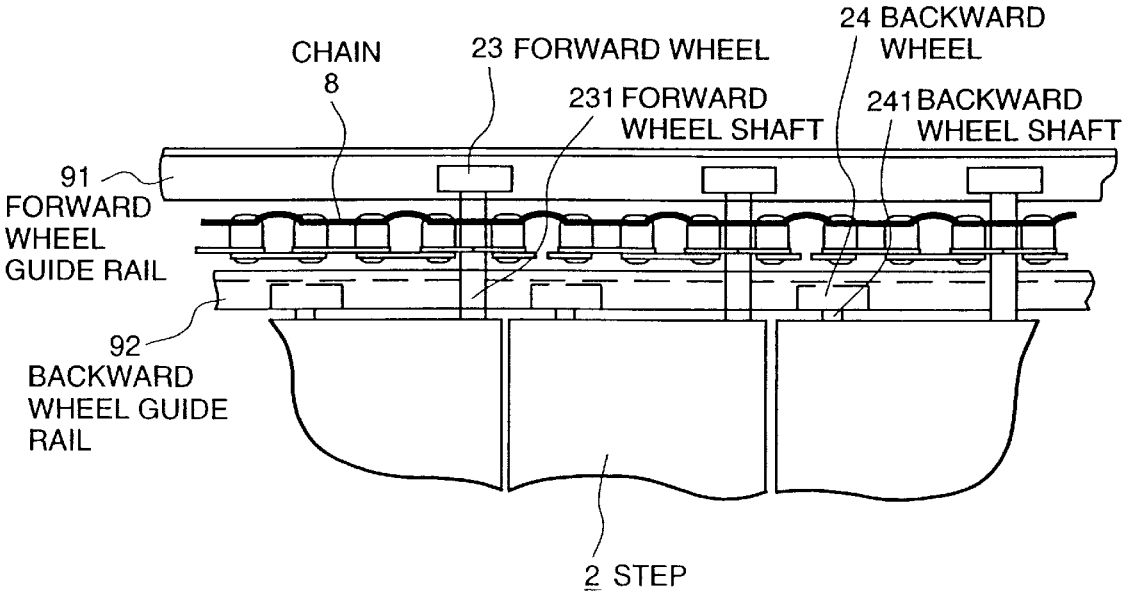
FIG. 4 is a plan view of the upper floor flat portion as seen along a line IV—IV of FIG. 3, viewed from above the escalator.

As shown in FIG. 4, the forward wheels 23 roll on a forward wheel guide rail 91 arranged further outside than the backward wheels 24. Further, the backward wheels 24 roll on a backward wheel guide rail 92 arranged further inside than the chain 8. Further, the thickness H of the escalator shown in FIG. 1 is determined according to the diameter of the path of rotation of the steps at each end of the escalator. That is, the escalator thickness H is composed of the diameter of the sprocket, an outer periphery locus of the steps 2 circulating around the sprocket and reversing in direction and safety distances secured at upper and lower portions thereof.

Figure 5:
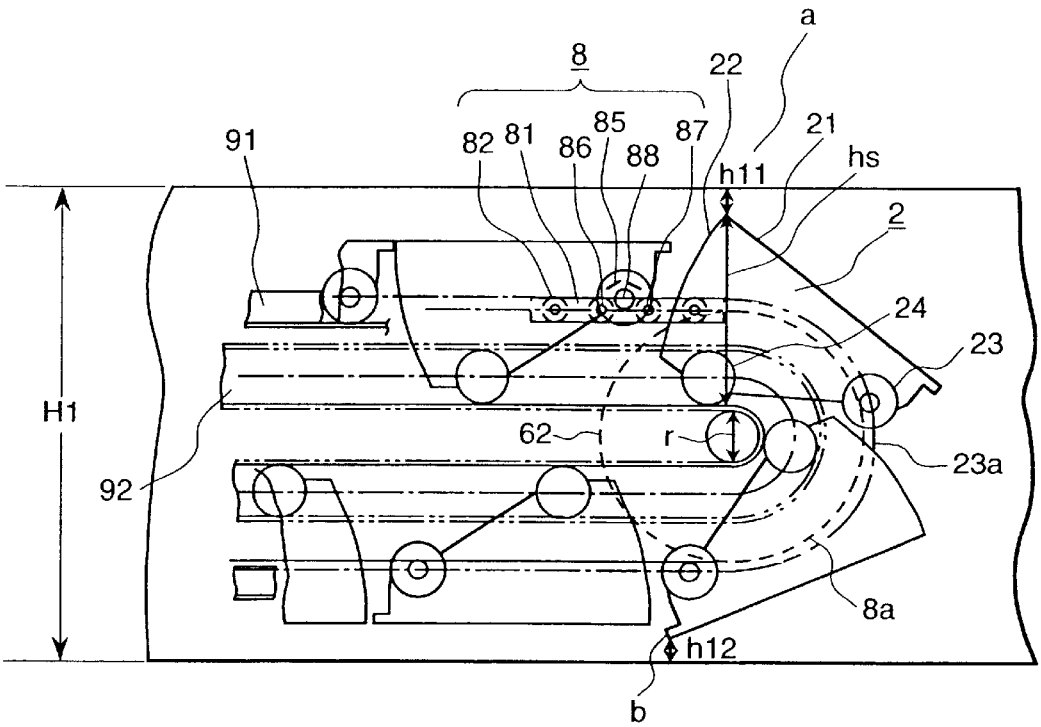
FIG. 5 is a side view of a rotation locus of a chain 8 and a step forward wheel 23 in an upper floor flat portion of an escalator representing an embodiment of the present invention.

An embodiment of the present invention in which the thickness H of an escalator is made small will be explained. FIG. 5 is a rough view of the construction of the chain 8 and the steps 2 in a reverse portion 14 at the top end of the escalator apparatus 1 (refer to FIG. 1), and FIG. 6 is a view illustrating a movement locus 8*a* of the chain 8 and a running locus 23*a* of the forward wheels 23.

Figure 6:
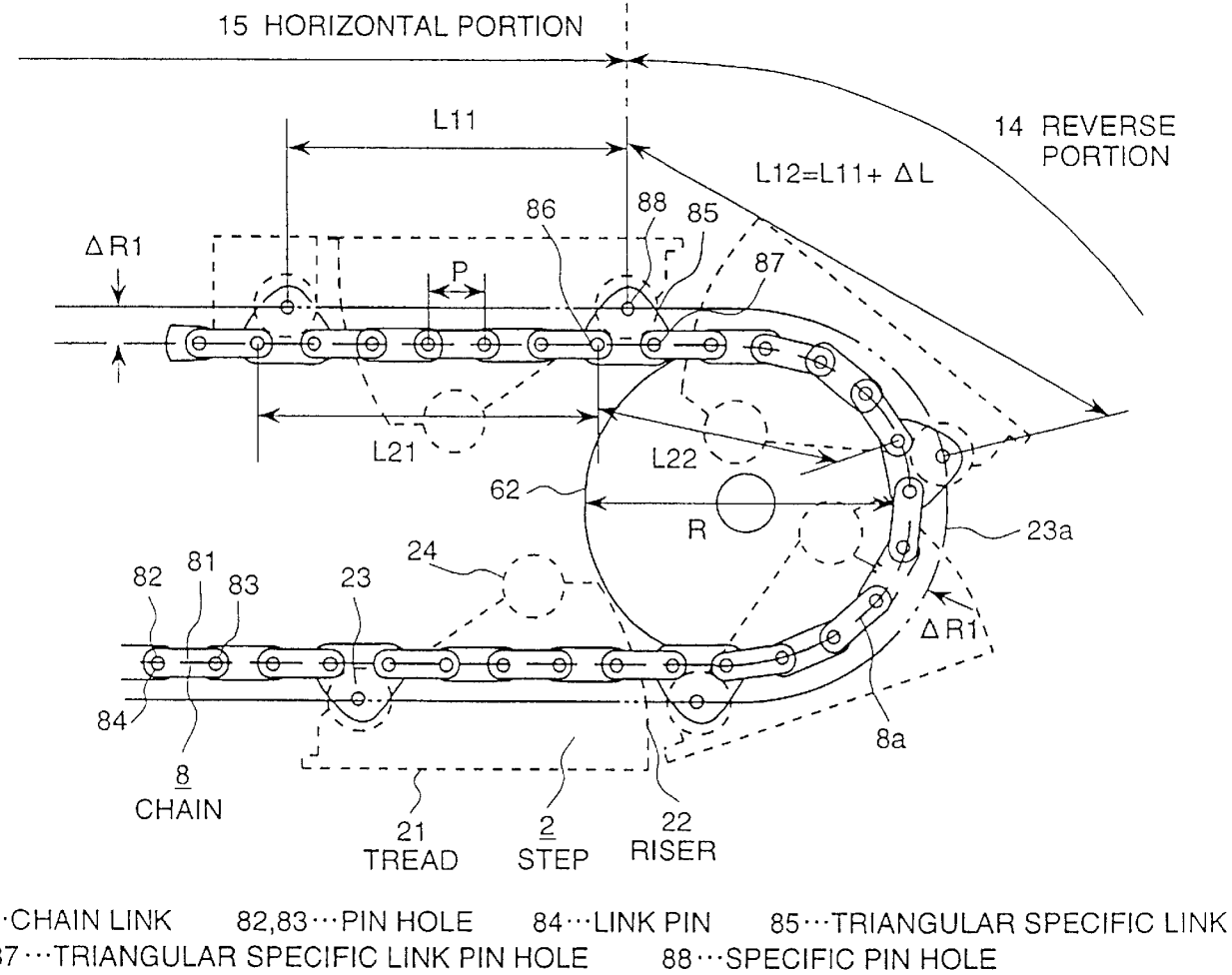
FIG. 6 is an enlarged side view of the upper floor flat portion of the escalator representing an embodiment of the present invention.

In FIGS. 5 and 6, the chain 8 wound around the driving sprocket 62 is composed of a plurality of chain links 81. Each chain link 81 has two pin holes 82, 83 and link pins 84 inserted in the pin holes to connect adjacent chain links thereto. Therefore, the distance between two pin holes corresponds to the length P of one pitch of the chain. The pitch length P is the length obtained by dividing the distance between forward wheel shafts of adjacent steps by the number of pitches between the forward wheel shafts.

In general, the number of chain pitches between the forward wheels is an even number because the chain has chain links of different construction connected alternately in order of outside, inside, outside . . . (refer to FIG. 4) and it is desirable for the forward wheels to be connected to chain links of the same construction. Therefore, for example, even number pitches, such as 4, 6, 8, 10, 12, etc are considered. However, in the case where 4 pitches are taken between forward wheel shafts, the interval per one pitch is large, so that smooth movement is not possible at the reverse portion, and when 10 or 12 pitches are taken between the forward wheel shafts, the interval per one pitch is short, so that the strength of meshing between the chain and the teeth of the sprocket becomes weak. Therefore, it is desirable for the chains between the forward wheel shafts to be 6 or 8 pitches.

As will be described later, the number of chain pitches between forward wheel shafts in the present embodiment is 6 pitches. The reason for this will be explained. Since the number of teeth of the driving sprocket is determined according to multiples of the number of chain pitches between forward wheel shafts, it is considered that the number of teeth of the driving sprocket is 12, 18, 24 or 30 teeth when 6 pitches are taken, and 16, 24, 32 or 40 teeth when 8 pitches are taken. The reason for this is that the number of teeth of the driving sprocket is determined in multiples of the number of pitches between forward wheel shafts, as will be explained hereunder.

Although not shown, in a conventional chain, connecting portions between the chain and forward wheel shafts are on the same locus as the movement locus of the chain, so that for a conventional driving sprocket, specific teeth (hereunder, referred to as specific teeth) were needed as the teeth which meet with the connecting portions to avoid interference with the connecting portions. In order to cause the chain links connected to the forward wheel shafts to mesh with the above-mentioned specific teeth, one tooth per each 6 teeth or one tooth per each 8 teeth should be provided as the specific tooth. Therefore, the number of teeth of the driving sprocket is determined in multiples of the number of chain pitches of the forward wheel shafts, and, as mentioned above, the number of teeth in the driving sprocket is 12, 18, 24, or 30 when 6 pitches are taken, and 16, 24, 32 or 40 when 8 pitches are taken.

In the present embodiment, there is a combination of 18 teeth on the driving sprocket and a chain pitch number of 6 pitches between forward wheel shafts is taken. The reason for this will be explained. First, when the number of teeth on the driving sprocket is 24 or more, the diameter of the driving sprocket becomes large, and although it is smaller than the diameter of a conventional driving sprocket, it is not possible to realize reduced thickness in an escalator to the extent desired by the present invention.

Further, when 12 teeth are provided in a case of 6 pitches and 16 teeth are provided in a case of 8 pitches, the diameter of the driving sprocket is too small (extremely small), so that interference between adjacent steps is large and it becomes impossible for the steps to be reversed in direction, with the interference being reduced.

Next, studying a combination of 6 pitches between forward wheel shafts and 18 teeth on the driving sprocket, a little interference occurs between adjacent steps, however, it is possible to avoid the interference by arranging the parts so that the locus of the connecting portions between the chain and the steps is further outside than the running locus of the chain. This principle will be explained hereunder.

First, an improvement in the construction will be described. As shown in FIGS. 5 and 6, triangular chain links 85 are provided at the connecting portions with the forward wheel shafts of the steps 2. That is, one of every 6 links of the links of the chain 2 is a triangular specific link 85. Each of the triangular specific links 85 at the connecting portion has 2 pin holes 86 and 87, and another pin hole 88 is provided at a position corresponding to an apex of a triangle to one side thereof on which the two pin holes exist. By the added pin holes 88, the forward wheel shafts 231 (refer to FIG. 3 or FIG. 4) of the steps 2 are connected to the chain 8. That is, the connecting portion with the forward wheel shaft of the step 2 is provided at a position outside of the two link pins. The step forward wheels 23 and the step backward wheels 24 roll on the forward wheel guide rail 91 and the backward wheel guide rail 92, respectively, as the chain 8 moves. In the present embodiment, the running locus 23*a* of the forward wheels of the steps 2 is formed to be outside the movement locus 8*a* of the chain 8 over the entire range of the escalator.

Next, the reason why interference between the steps does not occur with such a construction will be explained. As shown in FIG. 6, the chain 8 circulates in an arc around the diameter R of the sprocket, so that a straight distance L21 of 6 pitches in the horizontal portion 15 is shortened to a straight distance L22 of 6 pitches in the reverse portion 14. Therefore, in a case where the forward wheel shafts of the steps 2 are directly connected to the links of the chain 8, the movement locus 8*a* of the chain 8 draws an arc, whereby the straight distance between the forward wheel shafts of adjacent steps also is shortened in the same manner. That is, in the horizontal portion 15, adjacent steps move with a minimum gap therebetween for the safety of transportation. However, in the reverse portion 14, since the minimum gap of the adjacent steps is shortened, the adjacent steps interfere with each other and the arrangement becomes mechanically impossible.

In order to avoid interference between adjacent steps even if shortening occurs, in the present embodiment, the above-mentioned shortening of the straight distance is avoided in the following manner.

As shown in FIG. 6, the running locus 23*a* of the forward wheels of the steps 2 is raised by ΔR1 relative to the movement locus 8*a* of the chain 8. In the horizontal portion 15, the distance L11 between the forward wheel shafts of adjacent steps and the distance L21 between adjacent two specific links are the same. However, in the reverse portion 14, the distance L12 between the forward wheel shafts of two adjacent steps becomes longer by a periphery extension component ΔL corresponding to radius extension 66 R1 relative to the distance L22 between the specific links of the chain 8, so that L12=L11+ΔL. As a result, interference between adjacent steps does not occur. Therefore, it is possible to use a smaller driving sprocket 62 than a conventional one tp make the escalator thickness H1 small.

Figure 7:
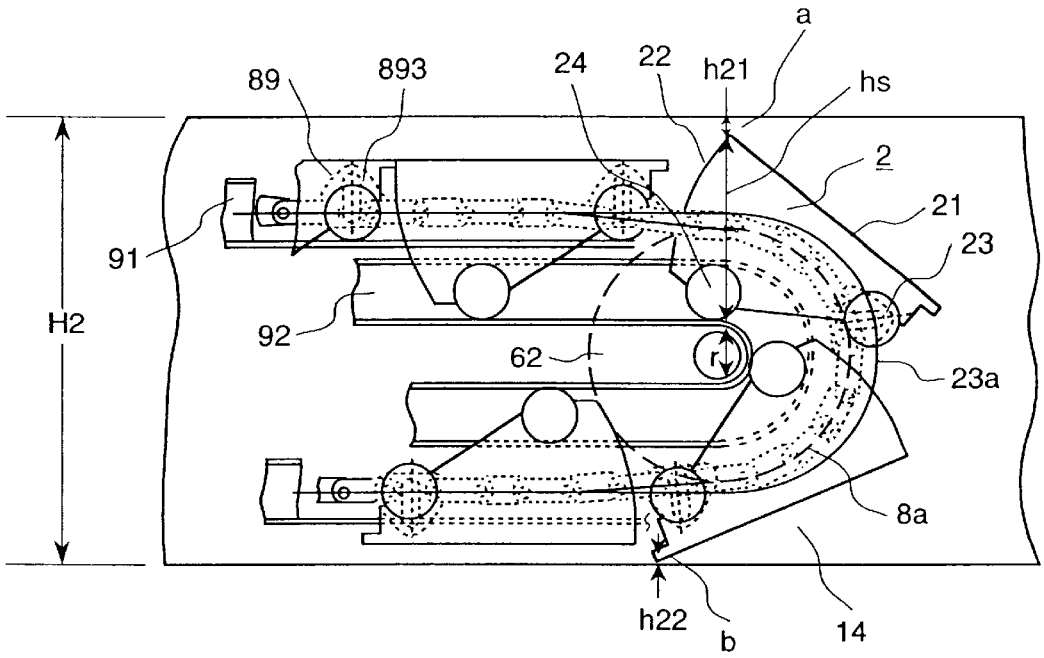
FIG. 7 is a side view of a rotation locus of a chain 8 and a step forward wheel 23 in an upper floor flat portion of an escalator representing another embodiment of the present invention.

Next, another embodiment of the present invention will be explained, referring to FIGS. 7 and 8. FIG. 7 is a rough view of the construction view of chain 8 and steps 2 in a reverse portion 14 of the escalator apparatus, and FIG. 8 is a view which illustrates the movement locus 8*a* of the chain 8 and the running locus of forward wheels 23 in the reverse portion 14.

Figure 8:
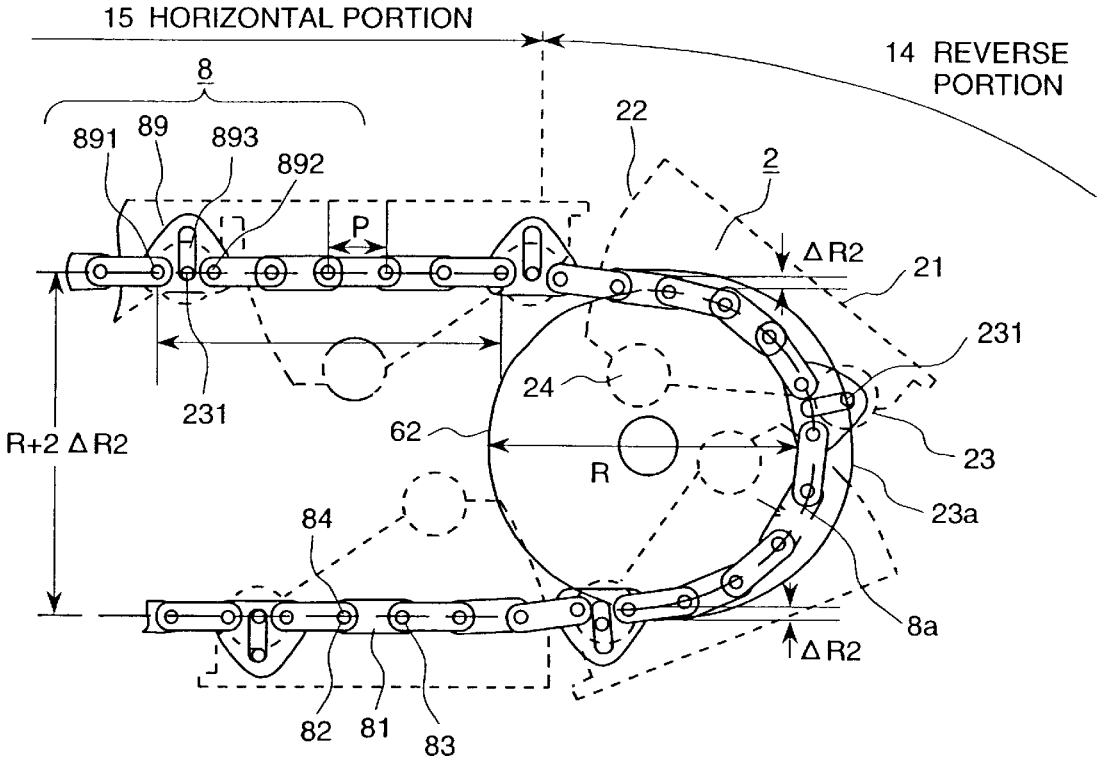
FIG. 8 is an enlarged side view of the upper floor flat portion of another embodiment of the present invention.

In FIGS. 7 and 8, constructions of chain links 81, pin holes 82, 83 and link pins 84 of the chain 8 wound on a driving sprocket 62 are the same as in the previously mentioned embodiment. In the present embodiment, triangular specific links 89 each having a pin with a hole different configuration from the previously mentioned pin hole are provided at connecting portions of the chain 8 and forward wheel shafts 231 of the steps 2. In the connecting portions, each triangular specific link 89 has two pin holes 891, 892 perforated therein, which is the same as mentioned previously, however, an elongated pin hole 893 (hereunder called a slot) elongated in a direction perpendicular to a running direction of the escalator is provided at a central portion of the specific link 89. By means of the slots 893, the forward wheel shafts 231 of the steps 2 are connected to the chain 8.

The slot 893 permits displacement of the forward wheel shaft 231 of the step 2 connected to the chain 8 in the horizontal portion 15 and in the reverse portion 14. The displacement is determined according to the direction in which the step forward wheel 23 is guided by the forward wheel guide rail 91 to move as will be mentioned next.

The details of the running locus 23*a* of the forward wheels 23 and the movement locus 8*a* of the chain 8 will be explained. In the present embodiment, the forward wheel guide rails 91 guiding the step forward wheels 23 are arranged so that the running locus 23*a* of the forward wheel shafts 231 of the steps 2 is the same as the running locus in the embodiment of FIGS. 5 and 6.

In the horizontal portion 15, the step forward wheels 23 roll on the forward wheel guide rails 91 with a locus drawn on the same straight line as the movement locus 8*a* of the chain 8. At this time, at the connecting portions, the forward wheel shaft 231 of the step 2 is disposed at the lowest portion of the slot 893. On the other hand, when the step reaches the reverse portion 14, the rotation locus 23*a* of the step forward wheels 23 start to follow a different locus from the movement locus 8*a* of the chain 8 being guided by the above-mentioned guide rail. At this time, at the connecting portions, the forward wheel shaft 231 of the step 2 gradually moves to an upper side of the slot 893. Then, at the final end of the reverse portion 14, the forward wheel shaft 231 of the step 2 is disposed at the most upper portion (oriented laterally at this position) of the slot 893, and then it gradually returns to its original position.

Therefore, in the reverse portion 14, since the running locus 23*a* of the step forward wheels is deviated outward from the ends of the escalator relative to the movement locus 8*a* of the chain 8, it is possible to use a smaller driving sprocket 62 than a conventional one and to reduce the thickness H2 of the escalator, without occurrence of interference between adjacent steps.

Now, the relation between the length Ls (refer to FIG. 2) of the tread 21 and the rotation diameter R of the chain 8 will be described. The total number of teeth of the driving sprocket 62 is 18 as mentioned previously, and the periphery corresponds to the length of 18 pitches. Therefore, the diameter R of the driving sprocket 62 is R=18/n≈5.73 pitch length. On the other hand, the length Ls of the tread 21 is equal to the length between the forward wheel shafts and 6 pitch length. Therefore, the rotation diameter R of the chain 8 is shorter than the length Ls of the tread 21.

Further, in the present embodiment, the distance between a forward course and a backward course of the chain 8 is extended more in the horizontal portion than in the reverse portion. The reason for this is as follows. As shown in FIG. 8, the diameter R of the driving sprocket 62 corresponds to the rotation diameter of the chain 8 without any change in the reverse portion 14; on the other hand, the distance between the forward and backward courses Ts extended to be R+2 ΔR2 in the horizontal portion 15. This is because the thickness H2 of the escalator is determined in the reverse portion 14 as shown in FIG. 7, and there are margins at the upper and lower portions in the horizontal portion. That is, the thickness H2 of the escalator is determined by a rotation diameter r of the step backward wheels 24, the maximum thickness hs of the step 2 in the reverse portion 14 and upper and lower safety distances h21 and h22 (H2=r+2hs+h21+h22), and the horizontal portion 15 has margins at upper and lower portions, respectively, as compared with the reverse portion.

Therefore, the distance between the forward and backward courses of the chain 8 is extended upward and downward, and the escalator is constructed so that the space formed between the forward and backward courses of the chain 8 in the horizontal portion 15 can be used effectively. However, it is not essential to extend the space, and, on the contrary, it can be narrowed.

In the present embodiment, the chain 8 is meshed with about half the periphery, that is, 9 pitches, of the driving sprocket 62 in the reverse portion 14. At this time, since it is possible to extend or narrow the distance between the escalator forward and backward courses of the chain 8 in the horizontal portion 15 as mentioned above, it also is possible to increase or decrease the engagement of the chain 8 with the driving sprocket 62 by one tooth at each of the upper and lower portions in the escalator forward and backward courses. Thereby, when the number of chain pitches between forward wheels of adjacent steps is N, the number of pitches of the chain meshed with the driving sprocket 62 in the reverse portion 14 is 1.5 N±2, and in the case of N=6, the pitch number is 11 at a maximum and 7 at a minimum.

Figure 9A:
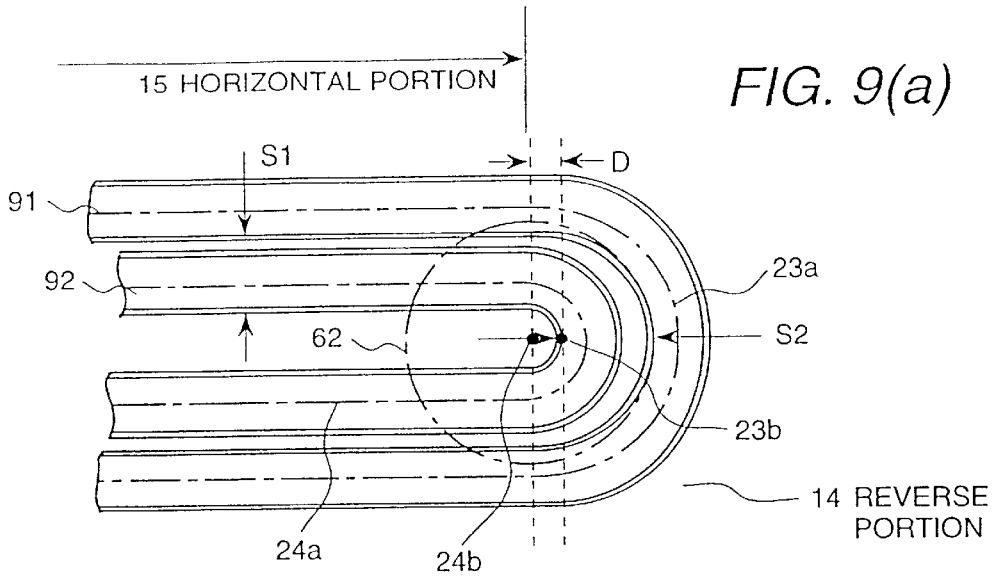
FIGS. 9(*a*) to 9(*c*) are side views of a guide rail of a forward wheel at a reverse portion.
Figure 9B:
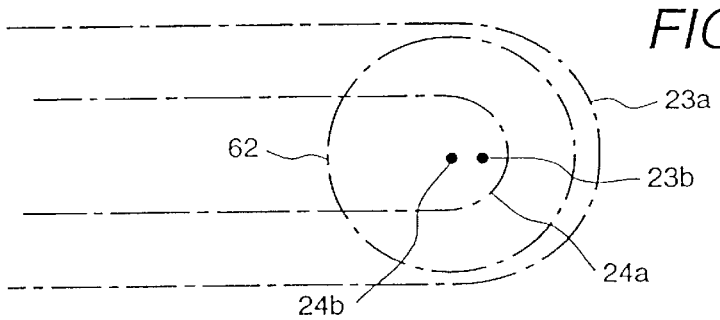
Figure 9C:
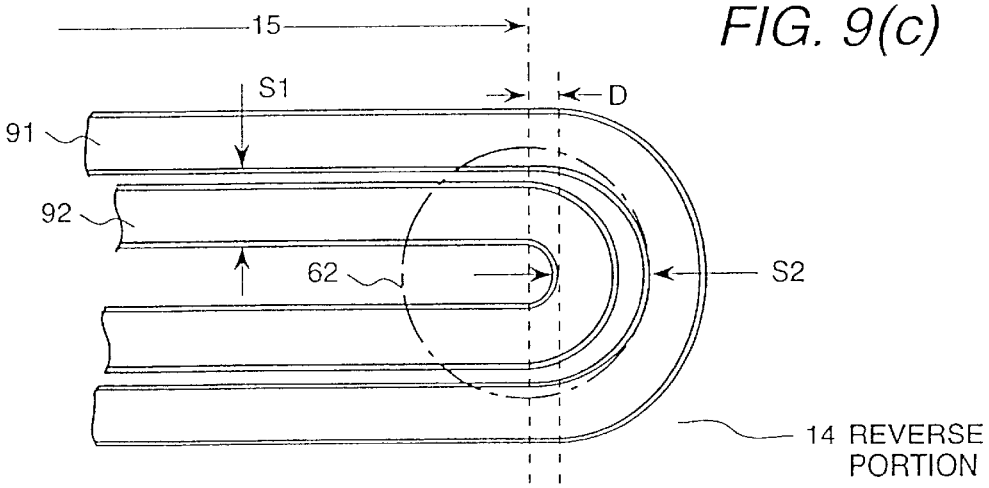

FIGS. 9(*a*) to 9(*c*) are diagrams illustrating a forward wheel guide rail 91 and the backward wheel guide rail 92, in which a center 23*b* of the rotation locus 23*a* of the step forward wheel is shifted toward the end portion of the escalator from a center 24*b* of the rotation locus 24*a* of the step backward wheel by a distance D.

In the present embodiment, as shown in FIG. 9(*c*), the distance S1 in the distance between the track of the forward wheel guide rail 91 and the track of backward wheel guide rail 92 in the horizontal portion 15 perpendicular to the running direction of the escalator. The distance S2 in the escalator horizontal direction between the track of the forward wheel guide rail 91 and the track of the backward wheel guide rail 92 in the reverse portion 14 is larger than the distance S2 perpendicular to the escalator running direction. This is because, in order to ensure that the step 2 does not interfere with the immediately preceding step, the forward wheel guide rail 91 is disposed so that the center 23*b* of rotation locus 23*a* of the step forward wheel is shifted outward of the escalator end portion from the center 24*b* of rotation locus 24*a* of the step backward wheel by the distance D in the reverse portion 14, as shown in FIG. 9(*a*).

Further, if the rotation locus 23*a* of the step forward wheel 23 is deviated from the rotation locus 8*a* of the chain 8 outward of the escalator end portion, the rotation locus 23*a* of the step forward wheel 23 does not need to be a half-circular shape, but can be elliptical or a combination of two arcs (double curves) whose diameters are different.

In the embodiment described above, the connecting portions between the chain 8 and the forward wheel shafts of the steps 2 are formed so as to be displaced outwardly from the locus of an outer peripheral portion of the teeth of the driving sprocket 62. In this manner, by this outside positioning, the connecting portions of the chain 8 with the steps 2 will not interfere with teeth of the driving sprocket 62. In this case, it is unnecessary to provide the driving sprocket 62 with the above-mentioned specific teeth. Therefore, the number of teeth of the driving sprocket 62 need not always be a multiple of the number of chain pitches between the forward wheel shafts, but can be freely determined as long as the number is in a range of 18 teeth or more and 24 teeth or less, which satisfies a desired escalator thickness H.

Next, sizes, etc. of the escalator will be explained. First, the sizes of the step 2 will be explained with reference to FIG. 2. The length Ls of the tread 21 is 381 mm, the maximum thickness hs of the step 2 is 270 mm and the height hh of the step 2 is 240 mm. The diameter R of the driving sprocket 62 is R=240 Mm. The diameter R of the driving sprocket 62 is shorter than the length Ls of the tread 21, as previously mentioned.

Here, the thickness H of the escalator is determined according to the rotation diameter r of the step backward wheel 24, and the maximum thickness hs of the step 2 and the safety distance h11, h12 in the escalator forward and backward courses, so that the escalator thickness H1 becomes H1=r+2hs+(h11+h12). Concretely, the rotation diameter r of the step backward wheel 24 is r=100 mm, the maximum thickness hs of the step 2 is hs=270 mm, upper and lower safety distances h11, h12 each are 20 mm and (h11+h12)=40 mm, and based on those sizes, H1=100+(2×270)+40=680 mm. The size H1 =680 mm is calculated assuming that the maximum thickness hs of the step influences the escalator thickness H1 also in the backward course in the same as in the forward course. However, in fact, it is sufficient for the rotation diameter to be a little smaller in the backward course. Therefore, it is possible to set the escalator thickness H to be a little smaller than 680 mm.

With the above construction, as shown in FIGS. 5 and 7, only two steps in total occupy the reverse portion 14. The escalator thickness H1 or H2 is determined by the distance between points a and b on the two steps in the reverse portion 14, with a little safety distance added thereto. Therefore, the escalator thickness H does not exceed the length (2×Ls) of two treads 21, and in the present embodiment, it is less than 762 mm.

According to the present invention, a smaller driving sprocket than a conventional one can be used, and it is possible to provide an escalator apparatus in which the escalator thickness can be made small.

What is claimed is:

1. An escalator apparatus, comprising:

an endless member which reverses in direction at end portions thereof;

a plurality of steps each having a tread and a riser, and a forward wheel and backward wheel, said steps being connected to said endless member via connecting portions; and driving means for driving said endless member to move said steps along a predetermined path;

wherein said connecting portions of said steps with said endless member circulate on a locus outside of said endless member so as not to overlap a locus of an outer end of said endless member, and so that a straight distance between connecting portions of two adjacent steps, which distance tends to shorten as said endless member follows an arc at both said end portions, is at both end portions.

2. An escalator apparatus according to claim 1, further comprising means for guiding said forward wheels and means for guiding said backward wheels along said predetermined path, whereby the distance between said guide means for said forward wheel and said guide means for said backward wheel is made larger at said end portions.

3. An escalator apparatus according to claim 1, further comprising means for shifting the locus of a center of rotation of said forward wheels toward an end portion more than the locus of a center of rotation of said backward wheels at both end portions.

4. An escalator apparatus according to claim 1, wherein the length of said tread in the running direction is 381 mm, and the thickness from a passenger entrance/exit floor of the escalator to an escalator body bottom portion is 762 mm or less.

5. An escalator apparatus according to claim 1, wherein the thickness from a passenger entrance/exit floor of said escalator to an escalator bottom portion is twice or more as large as the height of a step and twice or less as long as the length of a tread in the running direction.

6. An escalator apparatus, comprising:

a chain formed as an endless member so as to reverse in direction at end portions thereof;

a plurality of steps each having a tread and a riser, and a forward wheel and backward wheel, said steps being connected to said chain via connecting portions;

driving means for driving said chain to move said steps along a predetermined path;

means for guiding said chain so that a movement locus of said chain follows an arc at said end portions; and step guide means for guiding said connecting portions of said steps with said chain on a locus outside of said chain so as not to overlap a locus of an outer end of said chain at said end portions, and so that a straight distance between connecting portions of two adjacent steps, which distance tends to shorten as said chain follows said arc, is extended at both end portions.

7. An escalator apparatus according to claim 6, further comprising means for guiding said forward wheels and means for guiding said backward wheels along said predetermined path, whereby the distance between said guide means of said forward wheel and said guide means for said backward wheel is made larger at said end portions.

8. An escalator apparatus according to claim 6, further comprising means for shifting the locus of a center of rotation of said steps with said chain toward an end portion more than the locus of movement of said chain at both end portions, so that said connecting portions are circulated on a separate path outside of the path of said chain so as to not overlap a locus of the outer end of said chain at both end portions.

9. An escalator apparatus according to claim 6, wherein a rotation diameter of connecting portions of said steps with said chain is larger than a rotation diameter of said chain, so that said connecting portions are circulated on a separate path outside of the path of said chain so as not to overlap a locus of the outer end of said chain at both end portions.

10. An escalator apparatus according to claim 6, wherein said means for guiding said chain so that the locus of movement of said chain becomes an arc at said both end portions is arranged such that a running locus of the connecting portions of said steps with said chain is located outside said arc and is elliptic in shape at both end portions.

11. An escalator apparatus according to claim 6, wherein a running locus of connecting portions of said steps with said chain is located outside of the locus of movement of said chain along said entire predetermined path, so that said connecting portions are circulated on a separate locus outside said chain so as not to overlap the locus of the outer end of said chain at both end portions.

12. An escalator apparatus according to claim 6, further comprising an elliptic hole provided in each of the connecting portions of said steps with said chain, said elliptic hole being perpendicular to a running direction of said chain, and means for guiding said steps so that each of said connecting portions is connected to said chain at an outer side of said elliptic hole as said chain passes around both said end portions.

13. An escalator apparatus according to claim 6, wherein said chain has a plurality of links connected to each other, including specific links each having a connecting portion with said step attached on an outer side thereof, such that said connecting portion is circulated on a separate path outside said chain at said both end portions.

14. An escalator apparatus according to claim 6, wherein said chain meshes with sprockets at both said end portions, and wherein, when the number of chain pitches between connecting portions of adjacent steps with said chain is N, the number of chain pitches meshed with said sprocket at both end portions is 1.5±2.

15. An escalator apparatus according to claim 6, wherein a rotation diameter of the locus of movement of said chain is shorter than the length of said tread in a running direction at said both end portions.

16. An escalator apparatus according to claim 6, wherein the thickness from a passenger entrance/exit floor of said escalator to an escalator bottom portion is twice or more as large as the height of a step and twice or less as long as the length of a tread in the running direction.

17. An escalator apparatus according to claim 6, wherein said chain meshes with sprockets at both said end portions, and wherein said chain has six chain links in an interval between connecting portions of adjacent steps with said chain, and said sprockets each have eighteen teeth.

18. An escalator apparatus according to claim 6, where in said chain meshes with sprockets at both end portions, wherein the locus of movement of said backward wheels in a forward course is inside the locus of movement of said chain, and the diameter of the locus of rotation of said backward wheels in a reverse course is smaller than the diameter of the locus of rotation of said forward wheels, and wherein the connecting portions of said steps with said chain are constructed to be positioned outside of the locus of an outer periphery portion of the teeth of said sprockets.

19. An escalator apparatus, comprising:

an endless member reversed in a direction at both end portions;

a plurality of steps each having a tread and a riser, and a forward wheel and backward wheel, and connected to said endless member so as to be reversed at both aid end portions; and a driving means for driving said endless member to move said steps along a predetermined path;

wherein the diameter of the path of said endless member at an end portion is less than the distance between forward and backward courses on the path of the endless member.

20. An escalator apparatus according to claim 19, wherein connecting portions of said steps with said endless member are arranged so as to draw two straight lines and an arc-shaped locus connecting the straight lines on an outer side of a locus of said endless member.

* * * * *